US007738806B2

(12) United States Patent
Barton et al.

(10) Patent No.: US 7,738,806 B2
(45) Date of Patent: Jun. 15, 2010

(54) FUSER ASSEMBLIES, XEROGRAPHIC APPARATUSES AND METHODS OF FUSING TONER ON MEDIA

(75) Inventors: Augusto E. Barton, Webster, NY (US); Nicholas P. Kladias, Fresh Meadows, NY (US); David M. Thompson, Webster, NY (US); Anthony S. Condello, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 111 days.

(21) Appl. No.: 12/145,924

(22) Filed: Jun. 25, 2008

(65) Prior Publication Data

US 2009/0324272 A1 Dec. 31, 2009

(51) Int. Cl.
*G03G 15/20* (2006.01)

(52) U.S. Cl. ..... 399/69; 219/216; 399/45; 399/329; 430/124.3

(58) Field of Classification Search ..... 399/45, 399/67, 69, 328, 329, 330, 333, 334; 219/216, 219/255, 388; 347/156; 430/124.3
See application file for complete search history.

(56) References Cited

U.S. PATENT DOCUMENTS

| | | | |
|---|---|---|---|
| 4,001,545 | A | 1/1977 | Wada et al. |
| 4,075,455 | A | 2/1978 | Kitamura et al. |
| 4,297,562 | A | 10/1981 | Kamogawa et al. |
| 4,301,359 | A | 11/1981 | Ito et al. |
| 4,309,591 | A | 1/1982 | Kanoto et al. |
| 4,585,325 | A | 4/1986 | Euler |
| 4,801,968 | A | 1/1989 | Kogure et al. |
| 4,825,242 | A | 4/1989 | Elter |
| 5,300,996 | A | 4/1994 | Yokoyama et al. |
| 5,355,203 | A | 10/1994 | Nishikawa et al. |
| 5,497,218 | A | 3/1996 | Amico |
| 5,819,134 | A | 10/1998 | Sato et al. |
| 5,826,152 | A | 10/1998 | Suzuki et al. |
| 5,862,436 | A | 1/1999 | Ishizawa et al. |
| 5,899,599 | A | 5/1999 | Kato |
| 5,904,871 | A | 5/1999 | Sakai et al. |
| 6,008,829 | A | 12/1999 | Wakamiya et al. |
| 6,011,939 | A | 1/2000 | Martin |
| 6,181,891 | B1 | 1/2001 | Higashi et al. |
| 6,353,718 | B1 | 3/2002 | Roxon et al. |

(Continued)

FOREIGN PATENT DOCUMENTS

| | | |
|---|---|---|
| EP | 0361562 | 4/1990 |

(Continued)

*Primary Examiner*—Sophia S Chen
(74) *Attorney, Agent, or Firm*—Edward A. Brown; Prass LLP

(57) ABSTRACT

Fuser assemblies for fusing toner on media, xerographic apparatuses, and methods of fusing toner on media in xerographic apparatuses are disclosed. An embodiment of the fuser assemblies includes a fuser belt; a first roll supporting the fuser belt, the first roll including a first heating element and a second heating element extending axially along the first roll and along a width of the fuser belt, the first heating element being longer than the second heating element; and a second roll supporting the fuser belt, the second roll including a third heating element and a fourth heating element extending axially along the second roll and along the width of the fuser belt, the third heating element being longer than the fourth heating element.

18 Claims, 7 Drawing Sheets

U.S. PATENT DOCUMENTS

| | | | | |
|---|---|---|---|---|
| 6,505,832 | B2 | 1/2003 | Moore et al. | |
| 7,580,649 | B2 * | 8/2009 | Takagi et al. | 399/69 |
| 2004/0264991 | A1 * | 12/2004 | Yoshikawa | 399/69 |
| 2006/0171731 | A1 * | 8/2006 | Yoshikawa | 399/69 |
| 2007/0166084 | A1 * | 7/2007 | Yoshino et al. | 399/329 |

FOREIGN PATENT DOCUMENTS

| | | | |
|---|---|---|---|
| JP | 2001-201978 | A * | 7/2001 |

* cited by examiner

FUSER ASSEMBLIES, XEROGRAPHIC APPARATUSES AND METHODS OF FUSING TONER ON MEDIA

BACKGROUND

Fuser assemblies, xerographic apparatuses, and methods of fusing toner on media are disclosed.

In a typical xerographic printing process, toner images are formed on media, and then the toner is heated to fuse the toner on the media. One process used for thermal fusing toner onto media uses a fuser including a pressure roll, a fuser roll and a fuser belt positioned between these rolls. During operation, a medium with a toner image is fed to a nip between the pressure and fuser rolls, and the pressure roll presses the medium onto the heated fuser belt to fuse the toner onto the medium.

It would be desirable to provide fuser assemblies including fuser belts that can be used to print media of different widths efficiently.

SUMMARY

Fuser assemblies for xerographic apparatuses, xerographic apparatuses and methods of fusing toner on media in xerographic apparatuses, are provided. An exemplary embodiment of the fuser assemblies includes a fuser belt; a first roll supporting the fuser belt, the first roll including a first heating element and a second heating element extending axially along the first roll and along a width of the fuser belt, the first heating element being longer than the second heating element; and a second roll supporting the fuser belt, the second roll including a third heating element and a fourth heating element extending axially along the second roll and along the width of the fuser belt, the third heating element being longer than the fourth heating element.

DRAWINGS

Figure 1:
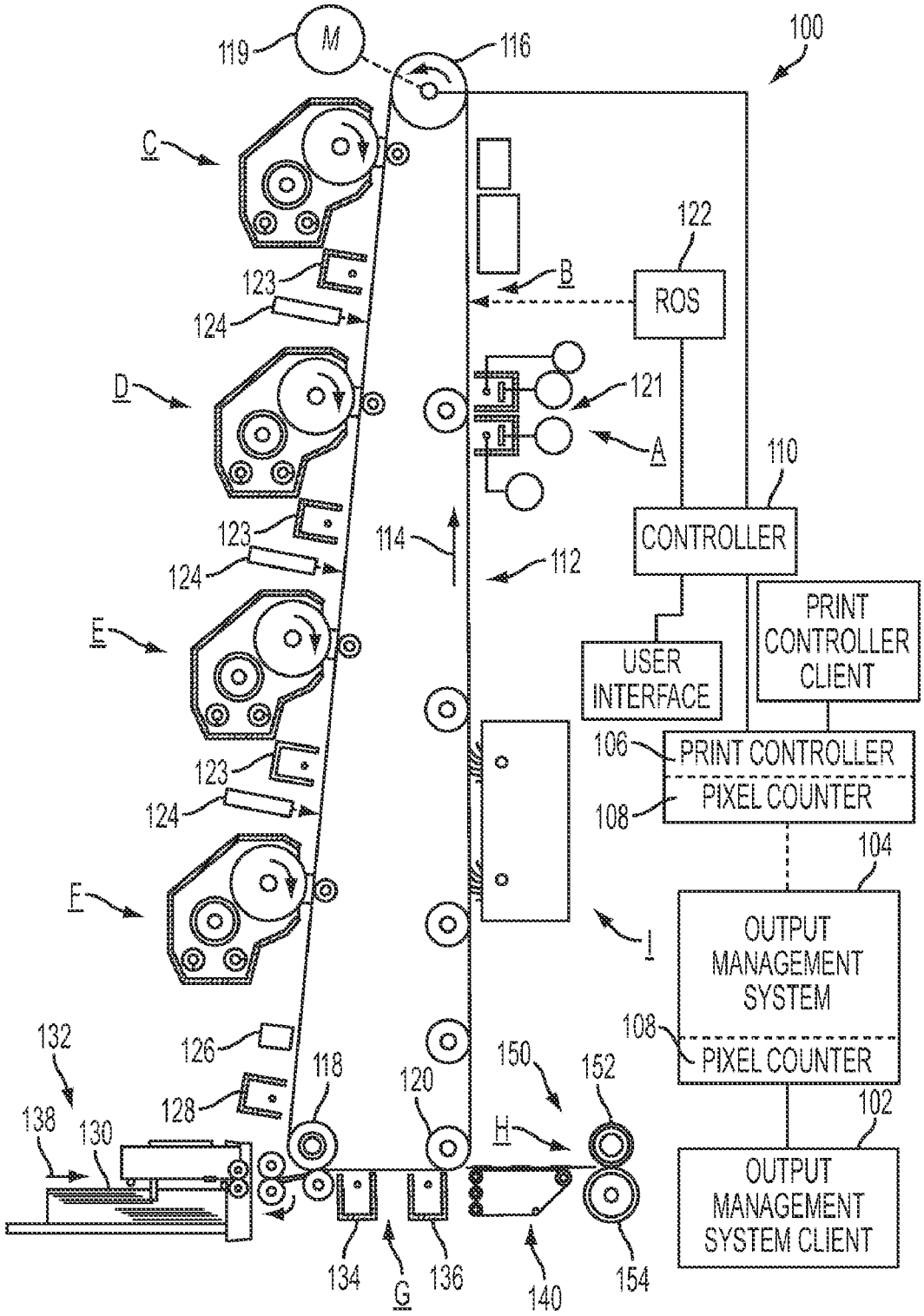
FIG. 1 illustrates an exemplary embodiment of a xerographic apparatus.

FIGS. 4A to 4D show calculated fuser belt outer surface temperature versus axial position curves for a fuser assembly including heating elements with two different lengths, and also for a fuser assembly including heating elements with five different lengths, for media widths of 7 in., 9 in., 11 in. and 13 in., respectively; and FIGS. 5A to 5D show calculated toner/media interface temperature versus axial position curves for a fuser assembly including heating elements with two different lengths, and also for a fuser assembly including heating elements with five different lengths, for media width ranges of 7 in. to 9 in., 9 in. to 11 in., 11 in. to 13 in., and 13 in. to 15 in., respectively.

DETAILED DESCRIPTION

The disclosed embodiments include a fuser assembly for a xerographic apparatus. The fuser assembly includes a fuser belt; a first roll supporting the fuser belt, the first roll including a first heating element and a second heating element extending axially along the first roll and along a width of the fuser belt, the first heating element being longer than the second heating element; and a second roll supporting the fuser belt, the second roll including a third heating element and a fourth heating element extending axially along the second roll and along the width of the fuser belt, the third heating element being longer than the fourth heating element.

The disclosed embodiments further include a fuser assembly for a xerographic apparatus, which includes a fuser belt including an outer surface; a fuser roll supporting the fuser belt, the fuser roll including a first heating element and a second heating element extending axially along the fuser roll and along a width of the fuser belt, the first heating element being longer than the second heating element; a first idler roll supporting the fuser belt, the first idler roll including a third heating element and a fourth heating element extending axially along the first idler roll and along the width of the fuser belt, the third heating element being longer than the fourth heating element; a pressure roll; a nip between the fuser roll and the pressure roll; a first temperature sensor for sensing a first temperature on the outer surface of the fuser belt at a first location; a second temperature sensor for sensing a second temperature on the outer surface of the fuser belt at a second location axially spaced from the first location; at least one power supply for supplying power to the first, second, third and fourth heating elements; and a controller connected to the power supply and to the first and second temperature sensors. The controller receives signals from the first and second temperature sensors indicating a temperature difference between the first and second temperatures and, based on the temperature difference and on a width of a medium that is fed to the nip, controls the power supply to turn the first, second, third and fourth heating elements ON and OFF to control a temperature profile across the width of the fuser belt.

The disclosed embodiments further include a method of fusing toner onto a medium using a fuser assembly. The fuser assembly includes a fuser belt supported on at least a first roll and a second roll, the fuser belt including an outer surface, a first side edge and a second side edge, the first roll including a first heating element and a second heating element extending axially along the first roll and along a width of the fuser belt defined by the first side edge and second side edge, the first and second heating elements having different lengths from each other, and the second roll including a third heating element and a fourth heating element extending axially along the second roll and along the width of the fuser belt, the third and fourth heating elements having different lengths from each other. The method includes sensing a first temperature on the outer surface of the fuser belt at a first location; sensing a second temperature on the outer surface of the fuser belt at a second location axially spaced from the first location; and turning the first, second, third and fourth heating elements ON and OFF to control a temperature profile across the width of the fuser belt based on the temperature difference between the first and second temperatures and on a width of the medium.

FIG. 1 illustrates an exemplary xerographic apparatus (digital imaging system) in which embodiments of the disclosed fuser assemblies can be used. Such digital imaging systems are disclosed in U.S. Pat. No. 6,505,832, which is hereby incorporated by reference in its entirety. The imaging system is used to produce an image, such as a color image output in a single pass of a photoreceptor belt. It will be understood, however, that embodiments of the fuser assemblies can be used in other imaging systems. Such systems include, e.g., multiple-pass color process systems, single or multiple pass highlight color systems, or black and white printing systems.

As shown in FIG. 1, printing jobs are sent from an output management system client 102 to an output management system 104. The output management system 104 supplies printing jobs to a print controller 106. A pixel counter 108 in the output management system 104 counts the number of pixels to be imaged with toner on each sheet or page of the print job, for each color. The pixel count information is stored in the memory of the output management system 104. Job control information is communicated from the print controller 106 to a controller 110.

The xerographic apparatus 100 includes a continuous (endless) photoreceptor belt 112 supported on a drive roll 116 and rolls 118, 120. The drive roll 116 is connected to a drive motor 119. The drive motor 119 moves the photoreceptor belt 112 in the direction of arrow 114 through the xerographic stations A to I shown in FIG. 1.

During the printing process, the photoreceptor belt 112 passes through a charging station A. This station includes a corona generating device 121 for charging the photoconductive surface of the photoreceptor belt 112.

Next, the charged portion of the photoconductive surface of the photoreceptor belt 112 is advanced through an imaging/exposure station B. At this station, the controller 110 receives image signals from the print controller 106 representing the desired output image, and converts these signals to signals transmitted to a laser raster output scanner (ROS) 122. The photoreceptor belt 112 undergoes dark decay. When exposed at the exposure station B, the photoreceptor belt 112 is discharged, resulting in the photoreceptor belt 112 containing charged areas and discharged or developed areas.

At a first development station C, charged toner particles, e.g., black particles, are attracted to the electrostatic latent image on the photoreceptor belt 112. The developed image is conveyed past a charging device 123 at which the photoreceptor belt 112 and developed toner image areas are recharged to a predetermined level.

A second exposure/imaging is performed by device 124. The device selectively discharges the photoreceptor belt 112 on toned areas and/or bare areas, based on the image to be developed with the second color toner. At this point of the process, the photoreceptor belt 112 contains areas with toner and areas without toner at relatively high voltage levels, as well as at relatively low voltage levels. These low voltage areas represent image areas. At a second developer station D, a negatively-charged developer material comprising, e.g., yellow toner, is transferred to latent images on the photoreceptor belt 112 using a second developer system.

The above procedure is repeated for a third image for, e.g., magenta toner, at station E, using a third developer system, and for a fourth image and color toner, e.g., cyan toner, at station F, using a fourth developer system. This procedure develops a full-color composite toner image on the photoreceptor belt 112. A mass sensor 126 measures the developed mass per unit area.

In cases where some toner charge is totally neutralized, or the polarity reversed, a negative pre-transfer dicorotron member 128 can condition the toner for transfer to a medium using positive corona discharge.

In the process, a medium 130 (e.g., paper) is advanced to a transfer station G by a feeding apparatus 132. The medium 130 is brought into contact with the photoreceptor belt 112 in a timed sequence so that the toner powder image developed on the photoreceptor belt 112 contacts the advancing medium 130.

The transfer station G includes a transfer dicorotron 134 for spraying positive ions onto the backside of the medium 130. The ions attract the negatively-charged toner powder images from the photoreceptor belt 112 to the medium 130. A detack dicorotron 136 facilitates stripping of media from the photoreceptor belt 130.

After the toner image has been transferred, the medium continues to advance, in the direction of arrow 138, onto a conveyor 140. The conveyor 140 advances the medium to a fusing station H. The fusing station H includes a fuser assembly 150 for permanently affixing, i.e., fusing, the transferred powder image to the medium 130. The fuser assembly 150 includes a heated fuser roll 152 and a pressure roll 154. The medium 130 is advanced between the fuser roll 152 and pressure roll 154 with the toner powder image contacting the fuser roll 152 to permanently affix the toner powder images to the medium 130. The medium 130 is then guided to an output device (not shown) for subsequent removal from the apparatus by the operator.

After the medium 130 has been separated from the photoreceptor belt 112, residual toner particles on non-image areas on the photoconductive surface of the photoreceptor belt 112 are removed from the photoconductive surface at a cleaning station I.

Xerographic apparatuses can be used to make prints using media having a range of widths. In fuser assemblies that include a fuser belt, it is desirable to use different fuser belt temperature profiles for printing different media widths in order to reduce or prevent the occurrence of cross-process gloss differentials and reduce overheating of the fuser belt outside the media path.

Figure 2:
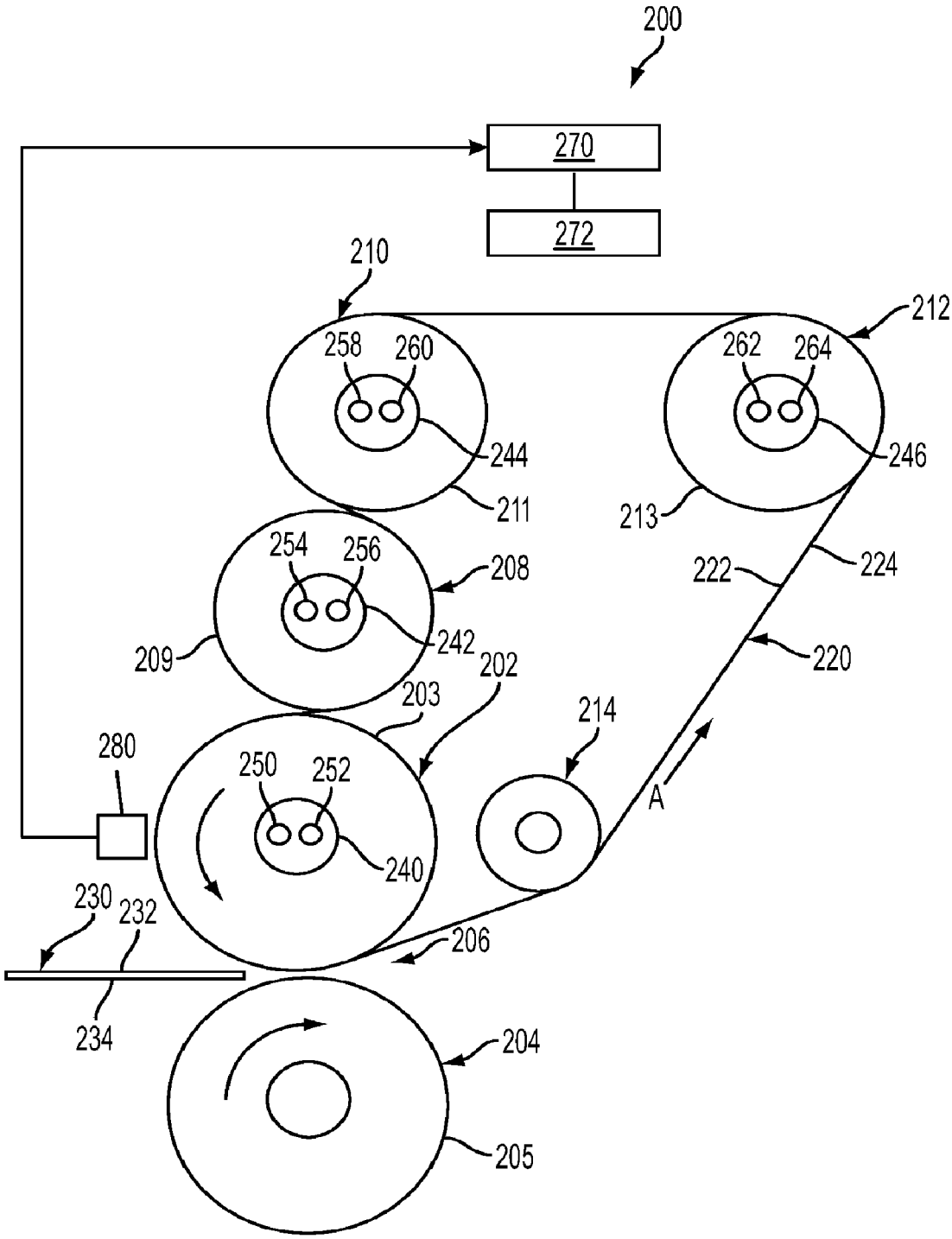
FIG. 2 illustrates an exemplary embodiment of a fuser assembly.

FIG. 2 illustrates an exemplary embodiment of a fuser assembly 200. Embodiments of the fuser assembly 200 can provide thermally-efficient fusing of toner on media having a wide range of widths. The fuser assembly 200 can be used in different types of xerographic apparatuses. For example, the fuser assembly 200 can be used in the xerographic apparatus shown in FIG. 1, in place of the fuser assembly 150.

Embodiments of the fuser assemblies include a fuser belt supported by two or more rolls. The rolls include heating elements having different lengths to heat the fuser belt. The heating elements are turned ON and OFF to control the fuser belt temperature so as to produce a desired fuser belt and medium temperature.

In the embodiment shown in FIG. 2, the fuser assembly 200 includes a fuser roll 202, a pressure roll 204 and a nip 206 between the fuser roll 202 and pressure roll 204. The fuser assembly 200 also includes multiple idler rolls 208, 210, 212 and 214. An endless (continuous) fuser belt 220 is supported on the fuser roll 202 and on the idler rolls 208, 210, 212 and 214. In other embodiments, the fuser assembly can include less than four or more than four idler rolls. In embodiments, the fuser roll 202 is rotated counter-clockwise by a drive mechanism, as indicated by arrow A, and the pressure roll 202 is rotated clockwise.

Embodiments of the fuser belt 220 have a multi-layer construction, including at least a base layer, an intermediate layer on the base layer, and an outer layer on the intermediate layer. The base layer forms the inner surface of the fuser belt, which contacts the rolls supporting the fuser belt. The outer layer forms the outer surface of the fuser belt. In an exemplary embodiment, the inner layer is composed of polyimide, or a like polymeric material; the intermediate layer is composed of silicone, or the like; and the outer layer is composed of a fluoroelastomer sold under the trademark Viton® by DuPont Performance Elastomers, L.L.C., or a like polymeric material. In the embodiment, the polyimide layer forms the inner surface 222, and the fluoroelastomer layer forms the outer surface 224, of the fuser belt 220. Typically, the base layer has a thickness of about 50 μm to about 100 μm, the intermediate layer has a thickness of about 200 μm to about 400 μm, and the outer layer has a thickness of about 20 μm to about 40 μm. The fuser belt 220 typically has a width of about 350 mm to about 450 mm.

In embodiments of the fuser assembly 200, the fuser belt 220 has a length of at least about 500 mm, about 600 mm, about 700 mm, about 800 mm, about 900 mm, about 1000 mm, or even longer. By using a longer fuser belt for embodiments of the fuser belt 220, the fuser belt 220 has a larger surface area for wear than shorter belts and, consequently, can provide a longer service life.

In embodiments, the fuser roll 202 includes a core 240, the idler roll 208 includes a core 242, the idler roll 210 includes a core 244, and the idler roll 212 includes a core 246. Each of the cores 240, 242, 244 and 246 is typically cylindrical shaped.

In the fuser assembly 200, the fuser roll 202 and the idler rolls 208, 210 and 212 are internally heated. In embodiments, the fuser roll 202 and idler rolls 208, 210 and 212 each include at least two heating elements. As shown in FIG. 2, the fuser roll 202 includes heating elements 250, 252; the idler roll 208 includes heating elements 254, 256; the idler roll 210 includes heating elements 258, 260; and the idler roll 212 includes heating elements 262, 264. In embodiments, the heating elements are elongated lamps, e.g., tungsten quartz lamps, located inside of the respective rolls. These heating elements extend axially along the fuser roll 202 and idler rolls 208, 210, 212. The heating elements are powered to supply heat to the outer surface 203 of the fuser roll 202, the outer surface 209 of the idler roll 208, the outer surface 211 of the idler roll 210, and the outer surface 213 of the idler roll 212, and to the inner surface 222 of the fuser belt 220 in contact with these outer surfaces.

In embodiments, the fuser roll 202 and the idler rolls 208, 210 and 212 each include at least two heating elements having different lengths from each other. In embodiments, the fuser roll 202 and the idler rolls 208, 210 and 212 each include a long heating element and a short heating element. In embodiments, the heating elements 250, 254, 258 and 262 can have the same length. In other embodiments, the lengths of one of more of these heating elements can vary in order to enable better temperature uniformity throughout the media width range. These lengths can be determined based on considerations including the total maximum power needed to fuse toner on all media and the available power of the individual heating elements. In embodiments, the heating element 250 is longer than the heating element 252, the heating element 254 is longer than the heating element 256, the heating element 258 is longer than the heating element 260, and the heating element 262 is longer than the heating element 264.

In embodiments, the heating elements 252, 256, 260 and 264 all have different lengths from each other. In such embodiments, when the heating elements 250, 254, 258 and 262 are of the same length, the fuser assembly 200 includes heating elements having a total of five different lengths in multiple rolls. In such embodiments, when the heating elements 250, 254, 258 and 262 all have different lengths, the fuser assembly 200 includes heating elements having a total of up to eight different lengths in multiple rolls.

In the embodiment of the fuser assembly 200 shown in FIG. 2, the idler roll 212 and the fuser roll 202 are the two heated rolls that are separated by the greatest distance from each other along the fuser belt 220. In the embodiment, the fuser belt 220 moves the greatest distance after it has been heated by one roll until it is then heated by another roll, when the fuser belt 220 is advanced from the fuser roll 202 to the idler roll 212. The fuser belt 220 is also cooled by contact with the medium 230 at the nip 206. To re-heat the fuser belt 220 more efficiently after it has contacted the medium 230 at the nip 206 and then been advanced from the fuser roll 202 to the idler roll 212, in embodiments, the short heating element 264 in the idler roll 212 can be longer than the short heating elements 260, 256 and 252 in the idler rolls 210, 208 and the fuser roll 202, respectively. By placing the longest one of the short heating elements inside the idler roll 212, a larger amount of heat can be supplied across a greater axial length of the idler roll 212, and a greater width of the fuser belt 220, by the two heating elements 262, 264. In other embodiments, the short heating elements can have a different arrangement and the longest one of the short heating elements can be provided in an idler roll other than the idler roll 212.

In embodiments, the heating element 260 in the idler roll 210 is longer than the heating element 256 in the idler roll 208, and the heating element 256 is longer than heating element 252 in the fuser roll 202.

Figure 3:
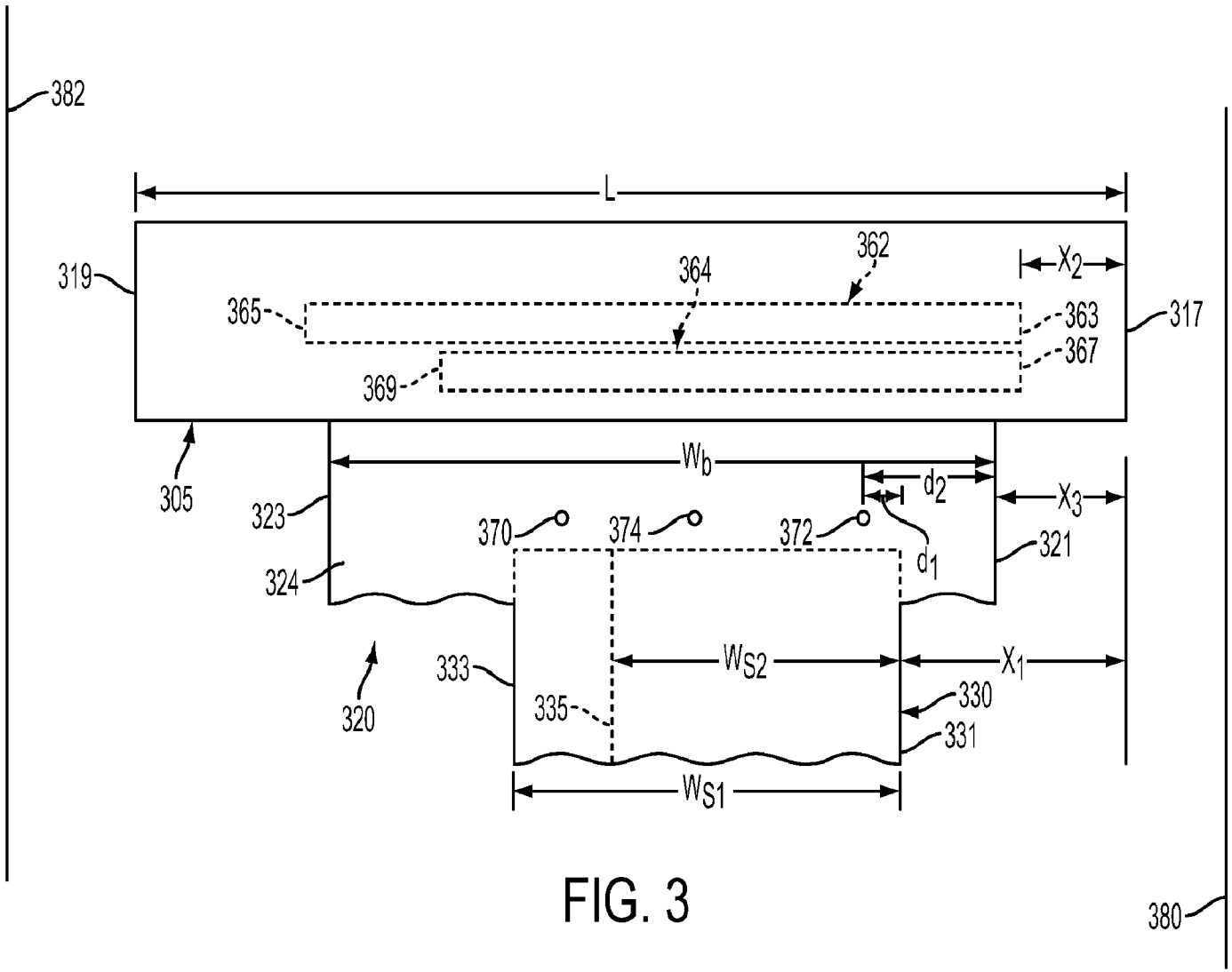
FIG. 3 illustrates an exemplary embodiment of a portion of a fuser assembly including a roll with heating elements and a fuser belt.

FIG. 3 depicts a portion of a fuser assembly in a xerographic apparatus. The fuser assembly includes a roll 305, and a fuser belt 320 supported on the roll 305. A medium 330 is shown in contact with the outer surface 324 of the fuser belt 320. The roll 305 can have the same general structure as any one of the fuser roll 202 and idler rolls 208, 210, 212. The length of the short heating element is different in each of these rolls. As shown, roll 305 has an outboard end 317 and an opposite inboard end 319. In embodiments, roll 305 can have a length, L, of, e.g., about 400 mm to about 500 mm, and the fuser belt 320 can have a width, $w_b$, of, e.g., about 350 mm to about 450 mm.

As shown in FIG. 3, the xerographic apparatus includes a front side 380 and a rear side 382. Roll 305 is oriented such that the outboard end 317 faces the front side 380, and the inboard end 319 faces the rear side 382. The fuser belt 320 has an outboard edge 321 and an inboard edge 323. In FIG. 3, the medium 330 is "outboard registered," meaning that the outboard edge 331 of the medium 330 is closer to the outboard edge 321 of the fuser belt 320 than the inboard edge 333 of the medium 330 is located with respect to the inboard edge 323 of the fuser belt 320. As shown, the outboard edge 331 of the medium 330 is spaced by a distance, $x_1$, from the outboard end 317 of roll 305.

In other embodiments, the medium 330 can be "inboard registered" in the xerographic apparatus. In such embodiments, the inboard edge 333 of the medium 330 is located closer to the inboard edge 323 of the fuser belt 320 than the outboard edge 331 of the medium 330 is located with respect to the outboard edge 321 of the fuser belt 320 (not shown). In other embodiments, the medium 330 can be "center registered" in the xerographic apparatus. In such embodiments, the medium 330 is axially centered on the fuser belt 320 (not shown).

As shown, roll 305 includes a long heating element 362 and a short heating element 364. In the embodiment, the heating elements 362, 364 can be heating lamps, which extend axially along the length of roll 305. The heating element 362 has an outboard end 363 and an opposite inboard end 365, and the heating element 364 has an outboard end 367 and an opposite inboard end 369. The outboard ends 363, 367 are axially aligned with each other and spaced by a distance, $x_2$, from the outboard end 317 of roll 305. The inboard end 365 of the long heating element 362 extends axially beyond the inboard end 369 of the short heating element 364, such that the inboard end 365 of the long heating element 362 is closer to the inboard end 319 of the roll 305 than is the inboard end 369 of the short heating element 364.

As shown, the fuser belt 320 can be centered along the longitudinal axis of roll 305 (i.e., axially centered) between the outboard end 317 and the inboard end 319. The outboard edge 321 of the fuser belt 320 is spaced by a distance, $x_3$, from the outboard end 317 of the roll 305. The outboard ends 363, 367 of the respective heating elements 362, 364 extend axially outward beyond the outboard edge 321 of the fuser belt 320. The inboard end 365 of the long heating element 362 extends axially outward beyond the inboard edge 323 of the fuser belt 320, while the inboard end 369 of the short heating element 364 is located axially inward from the inboard edge 323.

As shown in FIG. 3, the medium 330 can have a width, $w_{s1}$, or a narrower width, $w_{s2}$. An inboard temperature sensor 370 and an outboard temperature sensor 372 are positioned to sense the temperature of the outer surface 324 of the fuser belt 320 at two axially-spaced locations on the outer surface 324. As shown, an optional intermediate temperature sensor 374 can be located axially between the inboard temperature sensor 370 and the outboard temperature sensor 372 to provide a third temperature measurement at the outer surface 324 of the fuser belt 320. In embodiments, the temperature sensors 370, 372 (and optionally 374) can be positioned to sense the temperature of the outer surface of the fuser belt at, or upstream and adjacent, the fuser roll, where the temperature of the fuser belt reaches a maximum. The temperature sensors 370, 372 (and optionally 374) can be connected to a controller for controlling the heating elements in the different heated rolls. For example, in the fuser assembly 200 shown in FIG. 2, a temperature sensor 280 is positioned to measure the temperature of the outer surface 224 of the fuser belt 220 at the fuser roll 202. The temperature sensor 280 is provides feedback to the controller 270. The controller 270 controls the power supply 272, which controls the heating elements in the heated fuser roll 202 and idler rolls 208, 210, 212.

In embodiments, the outboard temperature sensor 372 can be spaced by the same distance, $d_2$, from the outboard edge 321 of the fuser belt 320, and spaced by the same distance, $d_1$, from the outboard edge 231 of the medium 330, for different media widths. Typically, $d_2$ can be about 20 mm to about 30 mm, and $d_1$ can be about 5 mm to about 10 mm.

In embodiments, the inboard temperature sensor 370 can be axially positioned relative to the location of the inboard edge of media for each selected media width sub-range. In embodiments, the inboard temperature sensor 370 can be axially positioned based on the width of the narrowest and the widest media within a given media width sub-range (i.e., based on the location of the inboard edge of such media). For example, for an exemplary broad numerical range of media widths of 7 in. to 15 in. that embodiments of the fuser assembly can be used to print based on the width of the fuser belt, this broad numerical range can be divided into numerical sub-ranges of the media width, e.g., 7 in. to 9 in. (about 178 mm to about 229 mm),) >9 in. to 11 in. (>229 mm to about 279 mm), >11 in. to 13 in. (>279 mm to about 330 mm), and >13 in. to 15 in. (>330 mm to about 381 mm). For each of these respective sub-ranges, the inboard temperature sensor 370 can be located at a position midway between the inboard edge for the narrowest-width medium and the inboard edge for the widest-width medium of that sub-range. For example, in an embodiment in which the width $w_{s1}$ shown in FIG. 3 indicates a medium having a width of 11 in. (about 279 mm), and the width $w_{s2}$ indicates a medium having a width of 9 in. (about 229 mm), the inboard temperature sensor 370 can be located about 1 in. (about 25 mm) inwardly from the inboard edge 333 of the 11 in.-wide medium (as shown), or, stated differently, about 1 in. (25 mm) outwardly from the inboard edge 335 of the 9 in.-wide medium.

In embodiments, when a medium having a width falling within the broad numerical range is to be printed, the medium is assigned to one of the sub-ranges. Information regarding the media width for a print job can be input to the xerographic apparatus by a user. The heating elements are turned ON and OFF according to an algorithm that controls the temperature profile across the width of the fuser belt based on the temperature difference determined by the inboard and outboard temperature sensors on the outer surface of the fuser belt and on the sub-range to which the medium has been assigned. For example, the algorithm shown in TABLE 1 can be used.

In embodiments, the fuser assembly can include more than one inboard temperature sensor. The two or more inboard temperature sensors can be axially spaced from each other in a sensor array also including the outboard temperature sensor. For example, in the embodiment shown in FIG. 3, at least one additional inboard temperature sensor can be positioned to sense the outer surface temperature of the fuser belt axially outward from the inboard temperature sensor 372. The number of inboard temperature sensors can be determined by optimization based on the algorithm that is used to control the ON/OFF state of the heating elements of the heated rolls of the fuser assembly. The algorithm can be provided in a memory connected to the controller 270.

In embodiments, the algorithm decides which heating element will be used to heat the fuser belt 220 based on both the media width and the difference between the inboard and outboard temperatures. When the inboard temperature is lower than the outboard temperature (by a selected value), the long heating elements will be used, while when the inboard temperature is higher than the outboard temperature (by a selected amount), the short heating elements will be used. The long and short heating elements used will depend on the media width in order to enable closer control of the fuser belt and media width temperature uniformity.

The inboard temperature sensor used in combination with the outboard temperature sensor can be selected based on the width of media that are to be printed with the fuser assembly. For example, for wider media, an inboard temperature sensor used in combination with the outboard temperature sensor can be located closer to the inboard ends of the heated rolls than an inboard temperature sensor used for printing of narrower media.

In embodiments of the fuser assembly 200, the respective outboard ends of the fuser roll 202 and idler rolls 208, 210, 212 can be approximately axially aligned with respect to each other. In such embodiments, the outboard ends of the heating elements 262, 264 of the idler roll 212; the outboard ends of the heating elements 258, 260 of the idler roll 210; the outboard ends of the heating elements 254, 256 of the idler roll 208; and the outboard ends of the heating elements 250, 252 of the fuser roll 202, can be axially aligned with each other and spaced by a distance equal to the distance $x_2$ (FIG. 3) from the outboard ends of the respective idler rolls 212, 210, 208 and the fuser roll 202. In such embodiments, the outboard end of the fuser belt 220 can be spaced by a distance equal to the distance $x_3$ (FIG. 3) from the outboard ends of the idler rolls 212, 210, 208 and the fuser roll 202. In such embodiments, for each media width processed with the fuser assembly 200, the outboard edges of the media are spaced by a distance equal to the distance $x_1$ (FIG. 3) from the outboard ends of the idler rolls 212, 210, 208 and the fuser roll 202.

During operation of the fuser assembly 200, the medium 230 (e.g., paper or other print medium) with at least one toner image (text and/or other type(s) of image) on at least the surface 232 is fed to the nip 206 by a sheet feeding apparatus. The heated idler rolls 208, 210, 212 and fuser roll 202 heat the fuser belt 220 to a sufficiently-high temperature to fuse (fix) the toner image(s) on the medium 230. At the nip 206, the outer surface 224 of the rotating fuser belt 220 contacts the surface 232 of the medium 230, and the outer surface 205 of the pressure roll 204 contacts the opposite surface 234 of the medium 230. The pressure roll 204 and fuser belt 220 apply sufficient pressure and heat to the medium 230 to fuse the toner.

The fusing temperature for fusing the toner on the medium 230 is based on various factors, including the thickness (weight) of the medium 230, and whether the medium 230 is coated or uncoated. The fusing temperature can be, e.g., about 150° C. to about 210° C. for various media.

The power supply 272 is connected to the heating elements of the fuser roll 202 and idler rolls 208, 210, 212 in any conventional manner. The controller 270 controls the power supply 272 to power the heating elements of the fuser roll 202 and idler rolls 208, 210, 212 based on characteristics of the media to be printed by the apparatus. The axial (i.e., width dimension) temperature profile of the fuser belt 220 is controlled by turning the short and long heating elements of each of the heated rolls ON and OFF. The axial temperature profile of the fuser belt 220 can be varied depending on the media width. By including multiple heating rolls, with heating elements of different lengths, the fuser assembly 200 can be used to process a broad range of media widths.

In embodiments, a potential broad range of media widths that may be printed with the fuser assembly 200 can be divided into two or more sub-ranges. In such embodiments, a control algorithm is defined for the heating elements of the fuser roll 202 and idler rolls 208, 210, 212. The control algorithm causes the short and long heating elements in these rolls to be turned ON and OFF based on temperature feedback provided at axially-spaced locations in the cross-process direction (i.e., width direction) of the fuser belt 220, and on the width of the media to be printed.

In embodiments of the fuser assembly 200, for each of the selected media width sub-ranges, the control algorithm causes the long heating elements and the short heating elements of the heated fuser roll 202 and idler rolls 208, 210, 212 to be turned ON and OFF based on the temperature difference, ΔT, between two axially-spaced locations of the fuser belt 220, as determined by the inboard temperature sensor 370 and the outboard temperature sensor 372. In embodiments, ΔT equals the difference between the temperature, $T_{inboard}$, as determined by the inboard temperature sensor 370 and the temperature, $T_{outboard}$, as determined by the outboard temperature sensor 372, i.e., $\Delta T = T_{inboard} - T_{outboard}$. In embodiments, depending on whether ΔT is above or below a selected value, certain heating elements are turned ON and other heating elements are turned OFF, to control the temperature profile across the width of the fuser belt. The maximum fuser belt temperature typically occurs at a location between the idler roll 208 and contact with the medium 230. In embodiments, the fuser belt temperature can be measured at this location. In embodiments of the fuser assemblies and the heating element control algorithm, the value of ΔT can be selected based on the desired level of uniformity of the temperature profile across the width of the fuser belt.

EXAMPLES

The operation of the fuser assembly 200 shown in FIG. 2 for printing media is modeled using a three-dimensional heat transfer code. In the model, the exemplary algorithm shown in TABLE 1 is used to turn the heating elements of the fuser roll 202 and idler rolls 208, 210, 212 of the fuser assembly 200 ON and OFF. In the model, the eight heating elements have the following five different lengths: heating elements 250, 254, 258, 262/420 mm; heating element 264/365 mm; heating element 260/315 mm; heating element 256/260 mm, and heating element 252/210 mm. In the algorithm, the broad range of the media width, w, of 7 in. to 15 in. is divided into four media width ranges of: 7 in.≦w≦9 in., 9 in.<w≦11 in., 11 in.<w≦13 in. and 13 in.<w≦15 in. The fuser belt 220 has a width of 400 mm. In each of the four ranges, the media are outboard registered with respect to the fuser belt 220 as shown in FIG. 3. In each of the four ranges, the outboard edges of the media are spaced from the outboard ends of the fuser roll 202 and idler rolls 208, 210, 212 by a distance of 52 mm, and are spaced from the outboard edge of the fuser belt 220 by a distance of 17 mm. In the model, toner is fused on the media at the nip at a rate of 165 pages/min. with the fuser assembly.

In TABLE 1, ΔT equals the difference between the temperatures on the fuser belt outer surface measured at the locations of the inboard temperature sensor and the outboard temperature sensor. For each media width range, the inboard temperature sensor is located at a position midway between the inboard edge for the narrowest-width medium and the inboard edge for the widest-width medium of that range. As shown in TABLE 1, 2° C. spaced is the value of ΔT used for turning the heating elements ON and OFF in the algorithm.

TABLE 1

| | | Idler Roll 212 | | Idler Roll 210 | | Idler Roll 208 | | Fuser Roll 202 | |
|---|---|---|---|---|---|---|---|---|---|
| Media Width, w [in.] | ΔT [° C.] | (Short) Heating Element 264 | (Long) Heating Element 262 | (Short) Heating Element 260 | (Long) Heating Element 258 | (Short) Heating Element 256 | (Long) Heating Element 254 | (Short) Heating Element 252 | (Long) Heating Element 250 |
| 7 ≦ w ≦ 9 | >2° C. | ON | | ON | | ON | | ON | |
| | <2° C. | | ON | | ON | | ON | | ON |
| 9 < w ≦ 11 | >2° C. | ON | | ON | | ON | | | ON |
| | <2° C. | | ON | | ON | | ON | | ON |
| 11 < w ≦ 13 | >2° C. | ON | | ON | | | ON | | ON |
| | <2° C. | | ON | | ON | | ON | | ON |
| 13 < w ≦ 15 | >2° C. | ON | | | ON | | ON | | ON |
| | <2° C. | | ON | | ON | | ON | | ON |

As shown in TABLE 1, based on the value of ΔT determined using the inboard and outboard temperature sensors, the algorithm is implemented. In TABLE 1, "ON" for a particular heating element means that when the roll including that heating element is below its set-point temperature, that heating element is powered on, and when that roll is above its set-point temperature, both the short and long heating elements of that roll are powered OFF.

According to the algorithm, the controller 270 causes the long heating elements to be turned on and the short heating elements to be turned OFF when the inboard-side (un-registered side) temperature of the fuser belt 220 is less than 2° C. higher, or is lower, than the outboard-side temperature of the fuser belt 220, and causes the long heating elements to be turned OFF and the short heating elements turned ON when the inboard-side temperature is more than 2° C. higher than the onboard-side temperature. In TABLE 1, this control is exemplified for the idler rolls 212, 210 and 208 and the fuser roll 202 for the media width range of $7 \leqq w \leqq 9$; the idler rolls 212, 210 and 208 for the media width range of $9 < w \leqq 11$; the idler roll 212, 210 for the media width range of $11 < w \leqq 13$; and the idler roll 212 for the media width range of $13 < w \leqq 15$.

Applying the control algorithm shown in TABLE 1 in the model, FIGS. 4A to 4D show the calculated outer surface temperature versus axial position of the fuser belt 220 for media (paper having a grammage of 350 gsm) having widths of 7 in., 9 in., 11 in. and 13 in., respectively, for the fuser assembly 200 including the five different heating element lengths (symbol "o"). In the curves, 0 mm represents the outboard edge, while 400 mm represents the inboard edge, of the fuser belt 220. The outer surface temperature of the fuser belt is determined at the exit of the idler roll 208 directly upstream from the fuser roll 202 after producing 600 prints.

FIGS. 4A to 4D also show the calculated outer surface temperature versus axial position of the fuser belt for media widths of 7 in., 9 in., 11 in. and 13 in., respectively, for a fuser assembly also including eight heating elements, but only two different heating element lengths (symbol "□"). In this case, the fuser roll 202 and idler rolls 212, 210 and 208 each include a long heating element and a short heating element. In the model, the long heating elements in each of the fuser roll 202 and idler rolls 212, 210 and 208 have the same length of 365 mm, and the short heating elements in each of the fuser roll 202 and idler rolls 212, 210 and 208 have the same length of 210 mm. Accordingly, each of these rolls includes a long heating element and a short heating element having the same lengths. The fuser belt has a width of 400 mm and the same multi-layer structure as in the fuser belt used with the arrangement including five different heating element lengths.

For the arrangement with only two different heating element lengths, the long and short heating elements are turned ON and OFF to control the temperature profile of the fuser belt for each media width based on the difference in temperature of the inboard and outboard sensors.

As shown in FIGS. 4A to 4D, using a fuser assembly including multiple heating rolls, with different short heating element lengths in each roll, and controlling the heating elements according to the exemplary algorithm shown in TABLE 1, the fuser assembly 200 can be used to process a broad range of media widths. The heating element configuration and algorithm can be used to prevent the inboard side region of the fuser belt 220 from being heated to above a desired maximum temperature.

TABLE 2 shows the calculated maximum temperature reached at the outer surface of the fuser belt for the fuser assembly including heating elements with only two different lengths, and the fuser assembly including heating elements with five different lengths, for media widths of 7 in., 9 in., 11 in. and 13 in. As shown in FIGS. 4A to 4D and in TABLE 2, using different heating element lengths in each roll reduces the maximum fuser belt temperature significantly for narrow media (e.g., media having a width of less than 11 in.), while it also does not compromise the maximum fuser belt outer surface temperature reached for wide media (FIGS. 5C and 5D). By reducing the fuser belt outer surface maximum temperature, the fuser belt can have a longer service life, and fuser belt edge wear can be decreased.

TABLE 2

| Media Width [in.] | Fuser Assembly With Two Different Heating Lamp Lengths - Fuser Belt Max. Outer Surface Temp [° C.] | Fuser Assembly With Five Different Heating Lamp Lengths - Fuser Belt Max. Outer Surface Temp [° C.] |
|---|---|---|
| 7 | 233 | 224 |
| 9 | 228 | 208 |
| 11 | 221 | 212 |
| 13 | 213 | 213 |
| 15 | 209 | 208 |

Comparing the curves in FIGS. 4A to 4D for a fuser assembly with five different heating element lengths, to the curves for a fuser assembly with only two different heating element lengths, it can be seen that that using different heating element lengths in each roll in combination with the exemplary algorithm shown in TABLE 1 can provide a more-uniform temperature profile across the width of the fuser belt 220 than the configuration with only two different heating element lengths. Consequently, using five different heating element lengths in combination with the algorithm shown in TABLE 1 can produce a more-uniform temperature profile across the width of media that come into contact with the fuser belt 220 at the nip 206 during fusing of toner on the media.

Figure 4A:
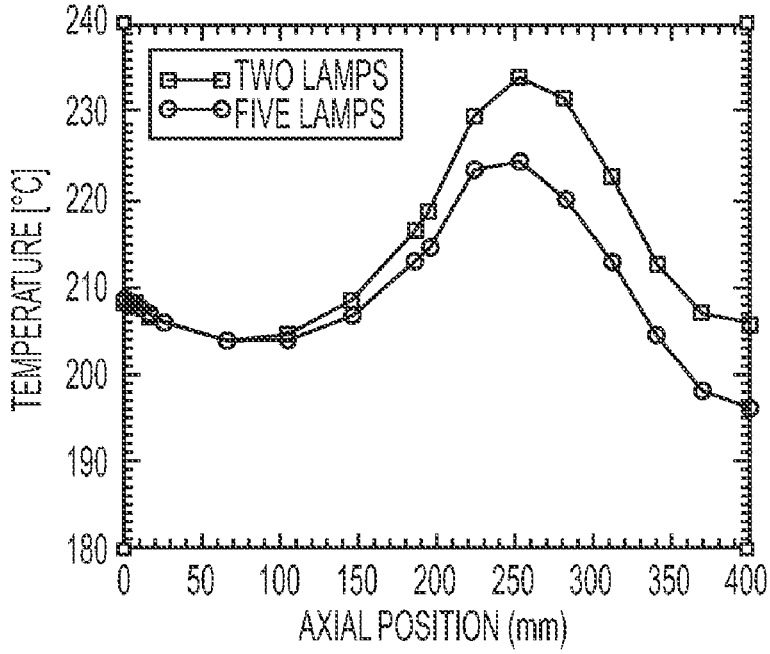
Figure 4B:
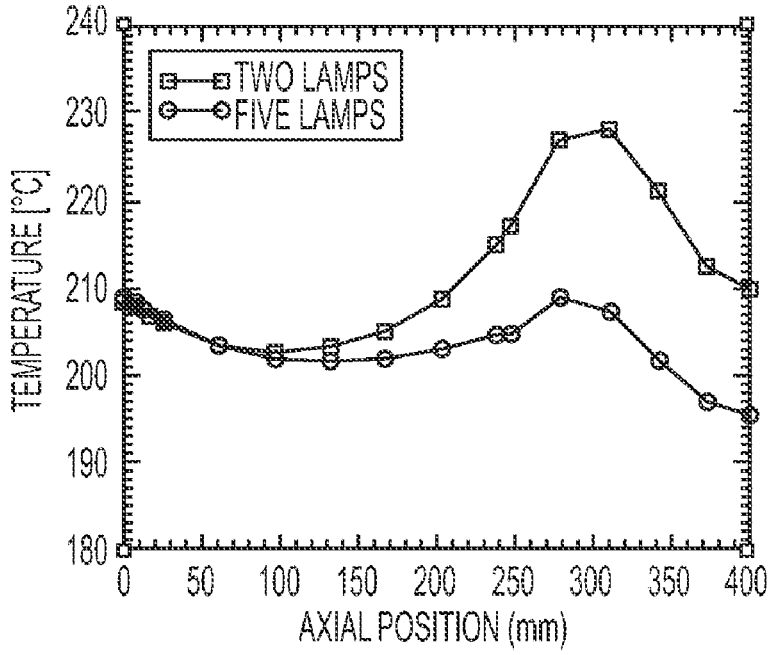
Figure 4C:
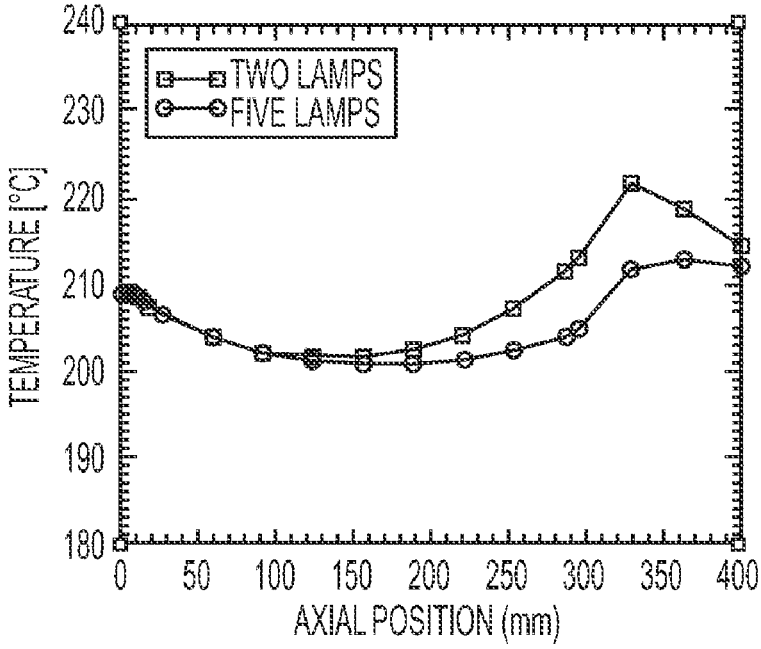
Figure 4D:
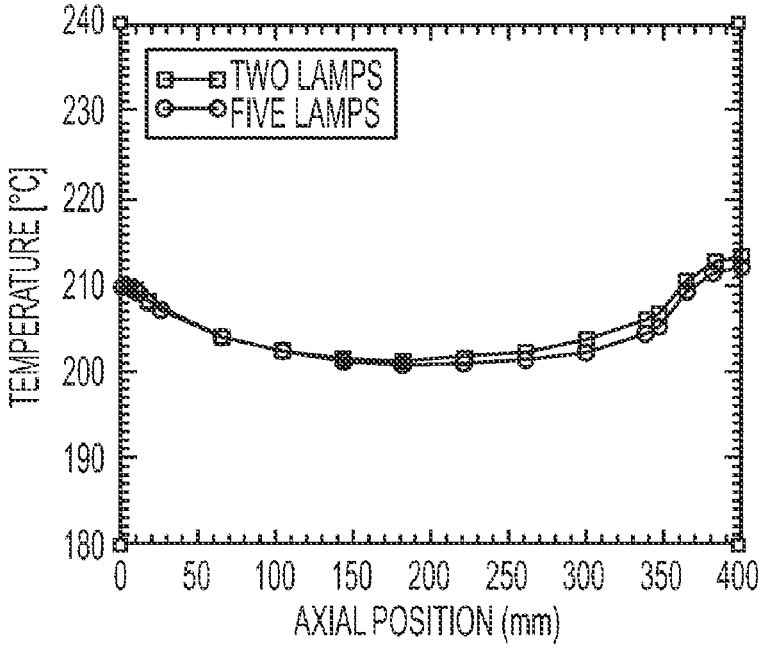

FIGS. 4A to 4D also show that a significantly lower temperature is reached on the outer surface of the fuser belt outside the media path using five different heating element lengths in combination with the algorithm shown in TABLE 1. This effect is greater for media widths of 7 in. to 11 in. (FIGS. 4A to 4C). For wider media (i.e., media having a width of 13 in. to 15 in.), the fuser belt surface temperatures attained with the five-heating element length configuration are similar to those attained using a two-heating element length configuration.

TABLE 3 shows the calculated total power consumption for fusing toner on media at a rate of 165 pages/min. using the fuser assembly including heating elements with only two different lengths, and the fuser assembly including heating elements with five different lengths. As shown, for each media width, the total power consumption for the fuser assembly with five heating element lengths is lower than that for the fuser assembly with only two heating element lengths. The five-heating element length configuration reduces the total power consumption significantly for narrower media (e.g., media having a width of less than 11 inches), and has comparable power consumption to the two-heating element length configuration for wider media. By reducing the total power consumption in this manner, the operating cost of xerographic apparatuses can be reduced.

TABLE 3

| Media Width [in] | Fuser Assembly With Two Different Heating Lamp Lengths - Total Power Consumption [W] | Fuser Assembly With Five Different Heating Lamp Lengths - Total Power Consumption [W] |
|---|---|---|
| 7 | 3240 | 2832 |
| 9 | 3687 | 3596 |
| 11 | 4268 | 4155 |
| 13 | 4569 | 4568 |
| 15 | 4907 | 4907 |

Figure 5A:
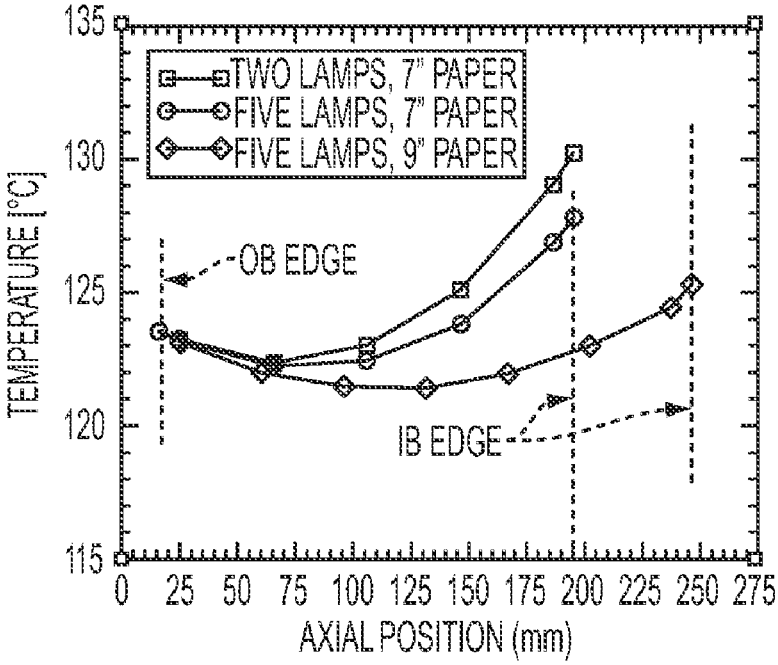
Figure 5B:
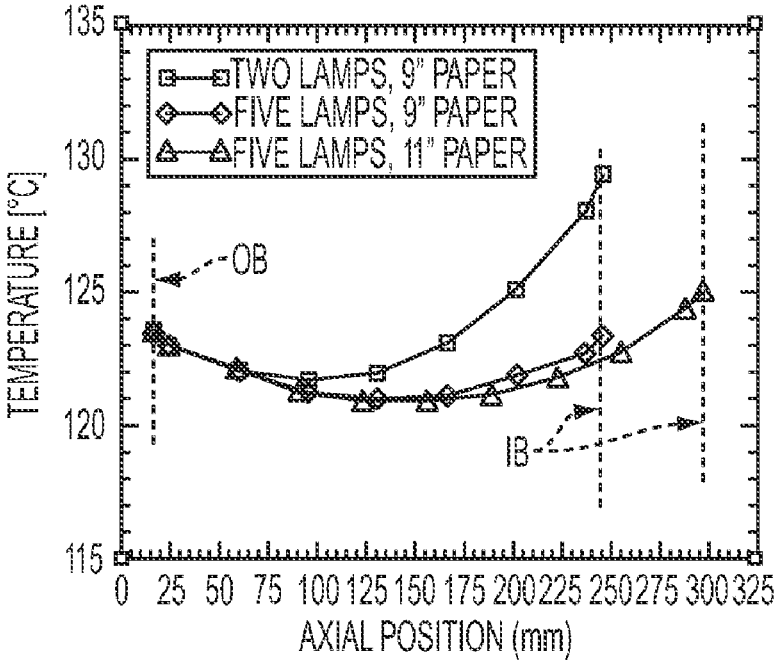
Figure 5C:
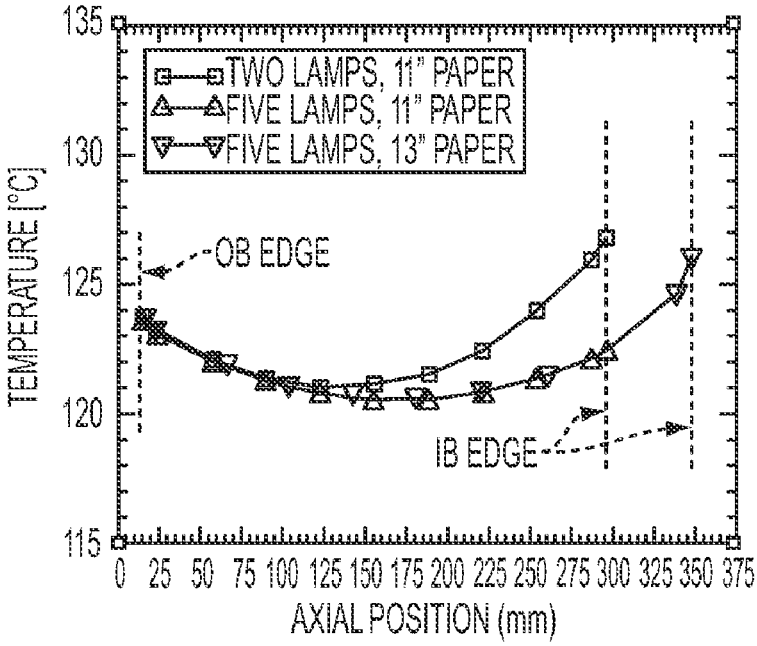
Figure 5D:
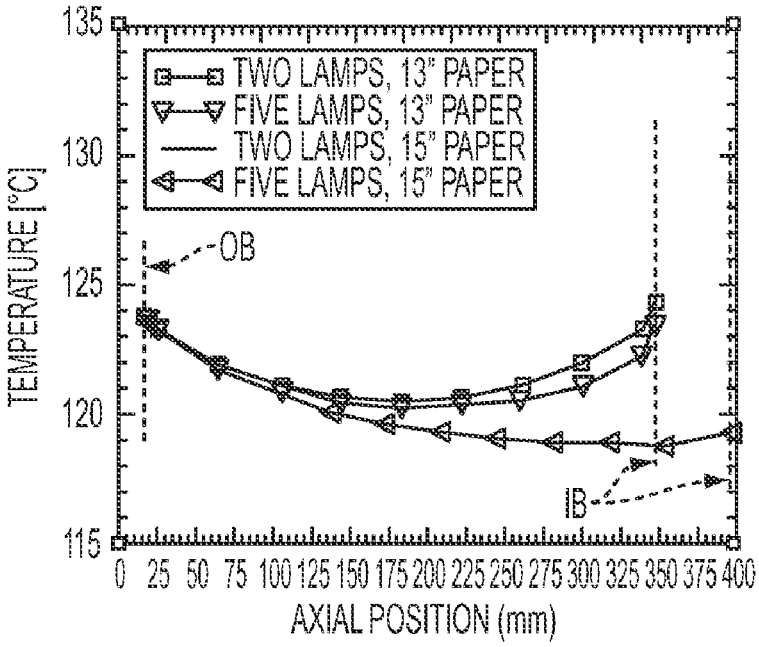

FIGS. 5A to 5D show calculated toner/medium interface temperature versus axial position curves for the same fuser assemblies including heating elements (lamps) with five different lengths and only two different lengths that are used to produce the curves shown in FIGS. 4A to 4D. The media used in the model are paper having a grammage of 350 gsm. The exemplary algorithm in TABLE 1 is used to control the heating elements in the fuser assembly including five different heating element lengths. FIG. 5A shows curves for media having a width of 7 in. and 9 in; FIG. 5B shows curves for media having a width of 9 in. and 11 in; FIG. 5C shows curves for media having a width of 11 in. and 13 in; and FIG. 5D shows curves for media having a width of 13 in. and 15 in, after making 600 prints for each of the media widths. The axial positions of the outboard side ("OB Side") and inboard side ("IB Side") of the fuser belt are indicated in FIGS. 5A to 5D.

As shown in FIGS. 5A to 5D, the axial temperature profile at the toner/medium interface after making the prints is more uniform for each media width for the fuser assembly with five different heating element lengths. For example, FIG. 5A shows that a more uniform toner/medium interface temperature profile is achieved with the five-heating element length configuration and control scheme for 7 in. wide media as compared to a two-heating element length scheme. By providing a more uniform toner/media interface temperature profile, gloss uniformity in the cross-process direction of media is improved. FIG. 5A also shows that a highly-uniform toner/media interface temperature profile is produced with the five-heating element length configuration and the algorithm for 9 in. wide media, which is the maximum width of the media width range of 7 in. to 9 in. considered. It is believed that the five-heating element length configuration and the algorithm in TABLE 1 can provide desirable results for all media widths within the range of 7 in. to 9 in.

The results shown in FIGS. 5B to 5D demonstrate that similar conclusions to those made regarding the curves in FIG. 5A can also be made for media widths within the ranges of 9 in. to 11 in., 11 in. to 13 in., and 13 in. to 15 in. The results shown in FIGS. 5B and 5C demonstrate significant improvements that can be provided by the five-heating element length configuration in comparison to a two-heating element length configuration in the narrow to medium media width ranges. Furthermore, FIG. 5D shows that the temperature profile achieved for wide media (13 in. to 15 in.) is not compromised by using a five-heating element scheme.

In addition to providing improved fuser belt and media cross-process (axial) temperature uniformity for a wide range of media widths, the use of a fuser assembly including multiple heating rolls, with heating elements of different lengths in the rolls, and controlling the heating elements according to embodiments of the control algorithm, such as the algorithm shown in TABLE 1, makes the fuser assembly more thermally efficient. In embodiments of the fuser assembly, the fuser belt temperature outside the media path can be reduced, thereby reducing thermal losses to the ambient. Reducing the fuser belt temperature outside the paper path can increase the life of the fuser belt outer layer. In addition, by reducing temperature gradients on the fuser belt outer surface near the media edge, belt edge-wear can be reduced, thereby also improving belt life.

Embodiments of the fuser assembly can be used for fusing toner in xerographic apparatuses that use oil for reducing offset, as well as in "oil-less" apparatuses that use toner particles containing a release agent, such as wax, instead of using release oil. The structure and composition of the layers of the fuser belt can be varied depending on whether release oil is used or not used in the xerographic apparatus.

It will be appreciated that various ones of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. A fuser assembly for a xerographic apparatus, comprising:

a fuser belt;

a first roll supporting the fuser belt, the first roll including a first heating element and a second heating element extending axially along the first roll and along a width of the fuser belt, the first heating element being longer than the second heating element; and a second roll supporting the fuser belt, the second roll including a third heating element and a fourth heating element extending axially along the second roll and along the width of the fuser belt, the third heating element being longer than the fourth heating element;

wherein the first and third heating elements have the same length, and the second and fourth heating elements have different lengths.

2. The fuser assembly of claim 1, further comprising a third roll supporting the fuser belt, the third roll including a fifth heating element and a sixth heating element extending axially along the third roll and along the width of the fuser belt, the fifth and sixth heating elements having different lengths from each other;

wherein:

the third roll is located between the first roll and the second roll along a length of the fuser belt;

the fifth heating element has the same length as the first and third heating elements;

the second heating element is shorter than the fourth heating element; and the fourth heating element is shorter than the sixth heating element.

3. The fuser assembly of claim 1, wherein:

the fuser belt has a width defined by a first side edge and a second side edge opposite the first side edge;

the first and third heating elements each includes an end disposed axially outward from the first side edge and an opposite end disposed axially outward from the second side edge; and the second and fourth heating elements each includes an end disposed outwardly from the first side edge and an opposite end disposed axially inward from the second side edge.

4. The fuser assembly of claim 1, further comprising:

a first temperature sensor for sensing a first temperature on an outer surface of the fuser belt at a first location; and a second temperature sensor for sensing a second temperature on the outer surface of the fuser belt at a second location axially spaced from the first location.

5. The fuser assembly of claim 4, further comprising:

at least one power supply for supplying power to the first, second, third and fourth heating elements; and a controller connected to the power supply and to the first and second temperature sensors;

wherein the controller receives signals from the first and second temperature sensors indicating a temperature difference between the first and second temperatures and, based on the temperature difference and on a width of a medium that comes into contact with the outer surface, controls the power supply to turn the first, second, third and fourth heating elements ON and OFF to control a temperature profile across the width of the fuser belt.

6. A xerographic apparatus, comprising:

a fuser assembly according to claim 1;

a pressure roll;

a nip between the first roll and the pressure roll; and a sheet feeding apparatus for feeding a medium having toner thereon to the nip where the fuser belt contacts the medium.

7. A fuser assembly for a xerographic apparatus, comprising:

a fuser belt;

a first roll supporting the fuser belt, the first roll including a first heating element and a second heating element extending axially along the first roll and along a width of the fuser belt, the first heating element being longer than the second heating element; and a second roll supporting the fuser belt, the second roll including a third heating element and a fourth heating element extending axially along the second roll and along the width of the fuser belt, the third heating element being longer than the fourth heating element;

wherein the first, second, third and fourth heating elements each has a different length.

8. A fuser assembly for a xerographic apparatus, comprising:

a fuser belt including an outer surface;

a fuser roll supporting the fuser belt, the fuser roll including a first heating element and a second heating element extending axially along the fuser roll and along a width of the fuser belt, the first heating element being longer than the second heating element;

a first idler roll supporting the fuser belt, the first idler roll including a third heating element and a fourth heating element extending axially along the first idler roll and along the width of the fuser belt, the third heating element being longer than the fourth heating element;

wherein the first and third heating elements have the same length, and the second and fourth heating elements have different lengths;

a pressure roll;

a nip between the fuser roll and the pressure roll;

a first temperature sensor for sensing a first temperature on the outer surface of the fuser belt at a first location;

a second temperature sensor for sensing a second temperature on the outer surface of the fuser belt at a second location axially spaced from the first location;

at least one power supply for supplying power to the first, second, third and fourth heating elements; and a controller connected to the power supply and to the first and second temperature sensors;

wherein the controller receives signals from the first and second temperature sensors indicating a temperature difference between the first and second temperatures and, based on the temperature difference and on a width of a medium that is fed to the nip, controls the power supply to turn the first, second, third and fourth heating elements ON and OFF to control a temperature profile across the width of the fuser belt.

9. The fuser assembly of claim 8, further comprising a second idler roll supporting the fuser belt, the second idler roll including a fifth heating element and a sixth heating element extending axially along the second idler roll and along the width of the fuser belt, the fifth and sixth heating elements having different lengths from each other;

wherein:

the fifth heating element has the same length as the first and third heating elements;

the second idler roll is located between the fuser roll and the first idler roll along a length of the fuser belt; and the second heating element is shorter than the fourth heating element; and the fourth heating element is shorter than the sixth heating element.

10. The fuser assembly of claim 8, wherein:

the fuser belt includes a first side edge and a second side edge opposite the first side edge;

the first and third heating elements each includes an end disposed axially outward from the first side edge and an opposite end disposed axially outward from the second side edge; and the second and fourth heating elements each includes an end disposed outwardly from the first side edge and an opposite end disposed axially inward from the second side edge.

11. A xerographic apparatus, comprising:

a fuser assembly according to claim 8; and a sheet feeding apparatus for feeding the medium, which has toner thereon, to the nip, where the outer surface of the fuser belt contacts the medium.

12. A fuser assembly for a xerographic apparatus, comprising:

a fuser belt including an outer surface;

a fuser roll supporting the fuser belt, the fuser roll including a first heating element and a second heating element extending axially along the fuser roll and along a width of the fuser belt, the first heating element being longer than the second heating element;

a first idler roll supporting the fuser belt, the first idler roll including a third heating element and a fourth heating element extending axially along the first idler roll and along the width of the fuser belt, the third heating element being longer than the fourth heating element;

wherein the first, second, third and fourth heating elements each has a different length;

a pressure roll;

a nip between the fuser roll and the pressure roll;

a first temperature sensor for sensing a first temperature on the outer surface of the fuser belt at a first location;

a second temperature sensor for sensing a second temperature on the outer surface of the fuser belt at a second location axially spaced from the first location;

at least one power supply for supplying power to the first, second, third and fourth heating elements; and a controller connected to the power supply and to the first and second temperature sensors;

wherein the controller receives signals from the first and second temperature sensors indicating a temperature difference between the first and second temperatures and, based on the temperature difference and on a width of a medium that is fed to the nip, controls the power supply to turn the first, second, third and fourth heating elements ON and OFF to control a temperature profile across the width of the fuser belt.

13. A method of fusing toner onto a medium using a fuser assembly comprising a fuser belt supported on at least a first roll and a second roll, the fuser belt including an outer surface, a first side edge and a second side edge, the first roll including a first heating element and a second heating element extending axially along the first roll and along a width of the fuser belt defined by the first side edge and second side edge, the first and second heating elements having different lengths from each other, and the second roll including a third heating element and a fourth heating element extending axially along the second roll and along the width of the fuser belt, the third and fourth heating elements having different lengths from each other, the first and third heating elements having the same length, and the second and fourth heating elements having different lengths, the method comprising:

sensing a first temperature on the outer surface of the fuser belt at a first location;

sensing a second temperature on the outer surface of the fuser belt at a second location axially spaced from the first location; and turning the first, second, third and fourth heating elements ON and OFF to control a temperature profile across the width of the fuser belt based on the temperature difference between the first and second temperatures and on a width of the medium.

14. The method of claim 13, wherein:

the fuser assembly further comprises a third roll supporting the fuser belt, the third roll including a fifth heating element and a sixth heating element extending axially along the third roll and along the width of the fuser belt, the fifth and sixth heating elements having different lengths from each other;

the fifth heating element has the same length as the first and third heating elements;

the third roll is located between the first roll and the second roll along a length of the fuser belt;

the second heating element is shorter than the fourth heating element;

the fourth heating element is shorter than the sixth heating element; and the first, second, third, fourth, fifth and sixth heating elements are turned ON and OFF to control the temperature profile across the width of the fuser belt based on the temperature difference between the first and second temperatures and on the width of the medium.

15. The method of claim 13, wherein:

when the medium has a first width:

the first and third heating elements are turned OFF, and the second and fourth heating elements are turned ON, to control the temperature profile across the width of the fuser belt when the first temperature exceeds the second temperature by more than a selected value; and the first and third heating elements are turned ON, and the second and fourth heating elements are turned OFF, to control the temperature profile across the width of the fuser belt when the first temperature does not exceed the second temperature by more than the selected value; and when the medium has a second width greater than the first width:

the first and fourth heating elements are turned ON, and the second and third heating elements are turned OFF, to control the temperature profile across the width of the fuser belt when the first temperature exceeds the second temperature by more than the selected value; and the first and third heating elements are turned ON, and the second and fourth heating elements are turned OFF to control the temperature profile across the width of the fuser belt when the first temperature does not exceed the second temperature by more than the selected value.

16. The method of claim 13, further comprising:

based on the width of the fuser belt, determining a numerical range of widths of media that can be processed using the fuser assembly;

dividing the numerical range into at least two numerical sub-ranges of the widths of the media;

based on the width of the medium, assigning the medium to one of the sub-ranges; and turning the first, second, third and fourth heating elements ON and OFF to control a temperature profile across the width of the fuser belt based on the temperature difference between the first and second temperatures and on the sub-range to which the medium has been assigned.

17. The method of claim 13, wherein the medium has a width of about 7 in. to about 15 in.

18. The method of claim 17, wherein the fuser belt has a length of at least 500 mm.

* * * * *